US006484891B2

(12) United States Patent
Burke

(10) Patent No.: US 6,484,891 B2
(45) Date of Patent: Nov. 26, 2002

(54) ADJUSTABLE TRACK SYSTEM FOR MODULAR DISPLAY SYSTEMS

(75) Inventor: Robert Paul Burke, Laguna Niguel, CA (US)

(73) Assignee: Burke Display Systems, Inc., Dana Point, CA (US)

( * ) Notice: Subject to any disclaimer, the term of this patent is extended or adjusted under 35 U.S.C. 154(b) by 0 days.

(21) Appl. No.: 09/817,769

(22) Filed: Mar. 26, 2001

(65) Prior Publication Data

US 2001/0035383 A1 Nov. 1, 2001

Related U.S. Application Data

(60) Provisional application No. 60/192,023, filed on Mar. 24, 2000.

(51) Int. Cl.[7] ..... A47F 1/04
(52) U.S. Cl. ..... 211/59.3; 211/184; 312/71
(58) Field of Search ..... 211/59.2, 59.3, 211/51, 184, 134, 175; 312/61, 71; 221/279; 108/61

(56) References Cited

U.S. PATENT DOCUMENTS

| | | | | |
|---|---|---|---|---|
| 2,110,299 A | * | 3/1938 | Hinkle | 211/59.3 |
| 2,652,154 A | | 9/1953 | Stevens | |
| 2,934,212 A | | 4/1960 | Jacobson | |
| 3,161,295 A | | 12/1964 | Chesley | |
| 3,308,961 A | | 3/1967 | Chelsey | |
| D256,301 S | | 8/1980 | Cutts | |
| 4,300,693 A | | 11/1981 | Spamer | |
| 4,303,162 A | | 12/1981 | Suttles | |
| 4,504,100 A | | 3/1985 | Chaumard | |
| 4,724,968 A | | 2/1988 | Wombacher | |
| 4,730,741 A | * | 3/1988 | Jackel, III et al. | 211/59.3 |
| 4,762,236 A | | 8/1988 | Jackie, III et al. | |
| 4,821,894 A | | 4/1989 | Dehirot | |
| D300,994 S | | 5/1989 | Wolff | |
| 4,830,201 A | * | 5/1989 | Breslow | 211/184 |
| 4,836,390 A | * | 6/1989 | Polvere | 211/59.3 |
| 4,898,282 A | | 2/1990 | Hawkinson et al. | |
| 4,899,893 A | | 2/1990 | Robertson | |
| 4,901,869 A | * | 2/1990 | Hawkinson et al. | 211/59.3 |
| 4,907,707 A | | 3/1990 | Crum | |
| 5,012,936 A | | 5/1991 | Crum | |
| D318,769 S | | 8/1991 | Marchiony et al. | |
| 5,069,349 A | | 12/1991 | Wear et al. | |
| 5,111,942 A | | 5/1992 | Bernardin | |
| 5,123,546 A | | 6/1992 | Crum | |
| 5,190,186 A | * | 3/1993 | Yablans et al. | 221/279 |
| 5,203,463 A | | 4/1993 | Gold | |
| 5,240,126 A | * | 8/1993 | Foster et al. | 211/59.3 |
| 5,265,738 A | * | 11/1993 | Yablans et al. | 211/59.3 |
| 5,353,939 A | | 10/1994 | Beeler et al. | |
| 5,366,033 A | | 11/1994 | Koivisto | |
| 5,366,099 A | | 11/1994 | Schmid | |
| 5,390,802 A | | 2/1995 | Pappagallo et al. | |
| 5,413,229 A | | 5/1995 | Zuberbuhler et al. | |
| 5,450,968 A | | 9/1995 | Bustos | |
| 5,450,969 A | | 9/1995 | Johnson et al. | |

(List continued on next page.)

FOREIGN PATENT DOCUMENTS

| | | | | |
|---|---|---|---|---|
| FI | 43097 | * | 1/1970 | 211/59.3 |
| FR | 2385365 | * | 12/1978 | 211/59.3 |

*Primary Examiner*—Bruce A. Lev
*Assistant Examiner*—Jennifer E. Novosad
(74) *Attorney, Agent, or Firm*—Knobbe, Martens, Olson & Bear, LLP

(57) ABSTRACT

A display rack comprises a frame, at least one dividing base unit and a track. The track supports a follower arrangement. The base unit comprises a partition wall and a support surface. The track is positioned on the support surface and is capable of lateral translation relative to the support surface. The base unit itself is laterally displaceable relative to the frame. The base unit reinforces the track unit against generally vertical bending forces.

17 Claims, 6 Drawing Sheets

U.S. PATENT DOCUMENTS 5,469,976 A 11/1995 Burchell
5,542,552 A * 8/1996 Yablans et al. ..... 211/59.3
5,562,217 A * 10/1996 Salveson et al. ..... 211/59.3
5,605,237 A * 2/1997 Richardson et al. ..... 211/59.3
5,634,564 A 6/1997 Spamer et al.
5,638,963 A 6/1997 Finnelly et al.
5,665,304 A * 9/1997 Heinen et al. ..... 312/71
5,673,801 A 10/1997 Markson
5,685,664 A * 11/1997 Parham et al. ..... 211/59.3
5,746,328 A * 5/1998 Beeler et al. ..... 211/59.3
5,806,690 A 9/1998 Johnson et al.
5,839,588 A * 11/1998 Hawkinson ..... 211/59.3
5,855,281 A 1/1999 Rabas
5,855,283 A * 1/1999 Johnson ..... 211/59.3
5,873,489 A * 2/1999 Ide et al. ..... 221/279
5,878,895 A 3/1999 Springs
5,881,910 A * 3/1999 Rein ..... 221/270
5,992,652 A 11/1999 Springs
5,992,653 A 11/1999 Anderson et al.
6,082,557 A 7/2000 Leahy
6,105,791 A * 8/2000 Chalson et al. ..... 211/59.2
6,142,317 A * 11/2000 Merl ..... 211/59.3
6,227,385 B1 * 5/2001 Nickerson ..... 211/59.3
6,234,328 B1 * 5/2001 Mason ..... 211/90.02
D445,615 S * 7/2001 Burke ..... D6/509

* cited by examiner

ADJUSTABLE TRACK SYSTEM FOR MODULAR DISPLAY SYSTEMS

RELATED APPLICATIONS

This application is related to, and claims the priority filing date of, United States Provisional Patent Application No. 60/192,023, which was filed on Mar. 24, 2000, which application is hereby incorporated by reference in its entirety.

BACKGROUND OF THE INVENTION

1. Field of the Invention

The present invention is generally related to display racks. More particularly, the present invention is related to display racks having follower assemblies supported on a track that is laterally repositionable relative to a supporting shelf 2. Description of the Related Art Shelving assemblies are used to display products in stores of all types. Due to the fierce competition among stores, great efforts are made to maintain a tidy appearance. For instance, many stores employ stock people who constantly reshelve merchandise or rotate merchandise to maintain an orderly appearance of products on the shelves. Paying people to perform such full time restocking can greatly increase overhead costs. Accordingly, stores have begun to use shelving that will urge the products forward such that a fully stocked appearance can be maintained although the shelves are not constantly being restocked.

Some stores have also recognized that reconfiguring the displays increases the time an individual spends in the store shopping. For instance, if products are not shuffled to some degree within a store, an individual that frequents that store proceeds directly to the location of the product they came looking for, picks up that product, pays for the product and leaves the store. On the other hand, by slightly shuffling product location on a periodic basis, the same individual spends more time wandering the aisles or otherwise browsing the product selection. The increase in time often will increase the number of impulse purchases made within the store.

Shelving that urges products forward, however, suffers from at least one major drawback in the shuffling of products. The shelving is difficult to reconfigure in a rapid manner. In addition, various products have different weights and, in some arrangements, the shelving has differing load-bearing capabilities. Thus, moving a large and heavy product to a shelving assembly previously configured for smaller and lighter products may not be possible. Instead, the products and the shelving assemblies would have to be relocated as a unit. This is a time consuming and tedious job.

SUMMARY OF THE INVENTION

Recently, a shelving assembly allowing rapid lateral readjustment has been created. Examples of such adjustable shelving assemblies having follower assemblies are disclosed in copending U.S. patent application Ser. No. 09/518,341, which was filed on Mar. 3, 2000, and co-pending U.S. patent application Ser. No. 09/379,704, which was filed on Aug. 24, 1999, both of which applications are hereby incorporated by reference in their entirety. These shelving assemblies comprise track units that are either integral with, or separately formed of, dividing walls. The track units can be adjusted side to side to increase or decrease the distance between the dividing walls. Thus, larger packages can be readily accommodated.

A drawback to simply adjusting the tracks and the dividers is readily apparent in the combined track and dividing wall configuration. In this configuration, the track, and therefore the follower assembly mounted on the track, are not centrally located between the two adjacent dividing walls. While the failure to centrally position the track and follower assembly may have little consequence in smaller and lighter products, such an off-center arrangement increases the wear rate when used with larger and heavier products. The torque created by the follower assembly can cause rapid system failure in some arrangements.

Similarly, if the track is formed separate of the vertically-extending dividing wall, large loads can cause failures in the track over time. For instance, without the vertically-extending dividing wall, the track is more likely to bow in the center over time if unsupported. The vertically-extending dividing wall stabilizes the attached track and provides reinforcement against vertical bowing. Thus, while separating the track and the dividing wall allows the track to be centralized between the dividing walls, the track can be largely unsupported and more susceptible to bowing and breaking along a central portion of the track.

Accordingly, a need exists for an easily adjusted display system that provides the advantages of forward-feeding display systems that admits of rapid reconfiguration while also allowing a more centralized follower assembly and increased vertical support for improved load-bearing characteristics.

Thus, one aspect of the present invention involves a display rack comprising a frame, a base unit and a track. The base unit comprises a generally vertical dividing wall portion and a generally horizontal support surface portion. The track is disposed on the generally horizontal support surface portion and the track carries a pusher block. The pusher block is capable of translating along the track in a generally longitudinal direction and is biased to a forward direction. The track is capable of translating along the support surface portion of the base unit in a generally lateral direction and the base unit being capable of translating along the frame in a generally lateral direction.

Another aspect of the present invention involves a display rack comprising a front panel, a rear panel spaced from the front panel and at least one divider generally extending between the front panel and the rear panel. The divider comprises a support surface and a partition. The divider is laterally slideable relative to the front panel. A track is laterally slideably positioned on the support surface and the track generally extends between the front panel and the rear panel. The track supports a forward biased pusher block and is connected to at least one of the front panel and the rear panel. The track is generally secured from substantial vertical movement and the track at least partially secures the divider from substantial vertical movement.

BRIEF DESCRIPTION OF THE DRAWINGS

These and other features, aspects and advantages of the present invention will be described with reference to several drawings of a preferred embodiment. The drawings comprise seven figures.

DETAILED DESCRIPTION OF THE PREFERRED EMBODIMENT

Figure 1:
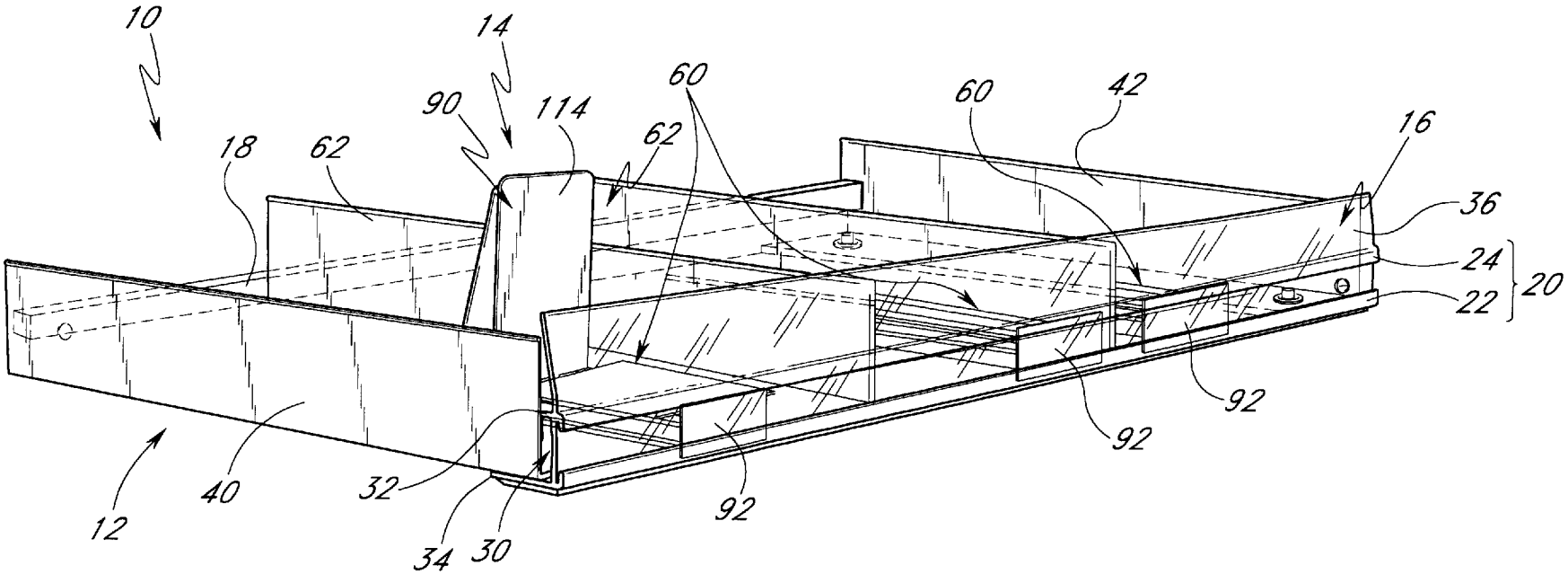
FIG. 1 is an overall perspective view of a display rack, arranged and configured in accordance with certain features, aspects and advantages of the present invention.

With reference initially to FIG. 1, an adjustable display rack for use as a shelf management system, generally designated by reference numeral 10, is illustrated. The adjustable display rack is configured and arranged to accept packages of various sizes, weights and configurations. For instance, the present adjustable display rack may be commonly used with prepackaged and bagged salads and other types of produce. Additionally, in one embodiment, the present adjustable display rack 10 may have particular utility with pharmaceutical products, such as drugs and vitamins. While certain features, aspects and advantages of the present invention typically are used with comestible products in stores, such as grocery stores and convenience marts, other features, aspects and advantages of the present adjustable display rack may find utility in a variety of other environments, including warehouses, hospitals, drug stores, office supply rooms, auto parts stores and clothing stores, for instance, but without limitation.

Figure 2:
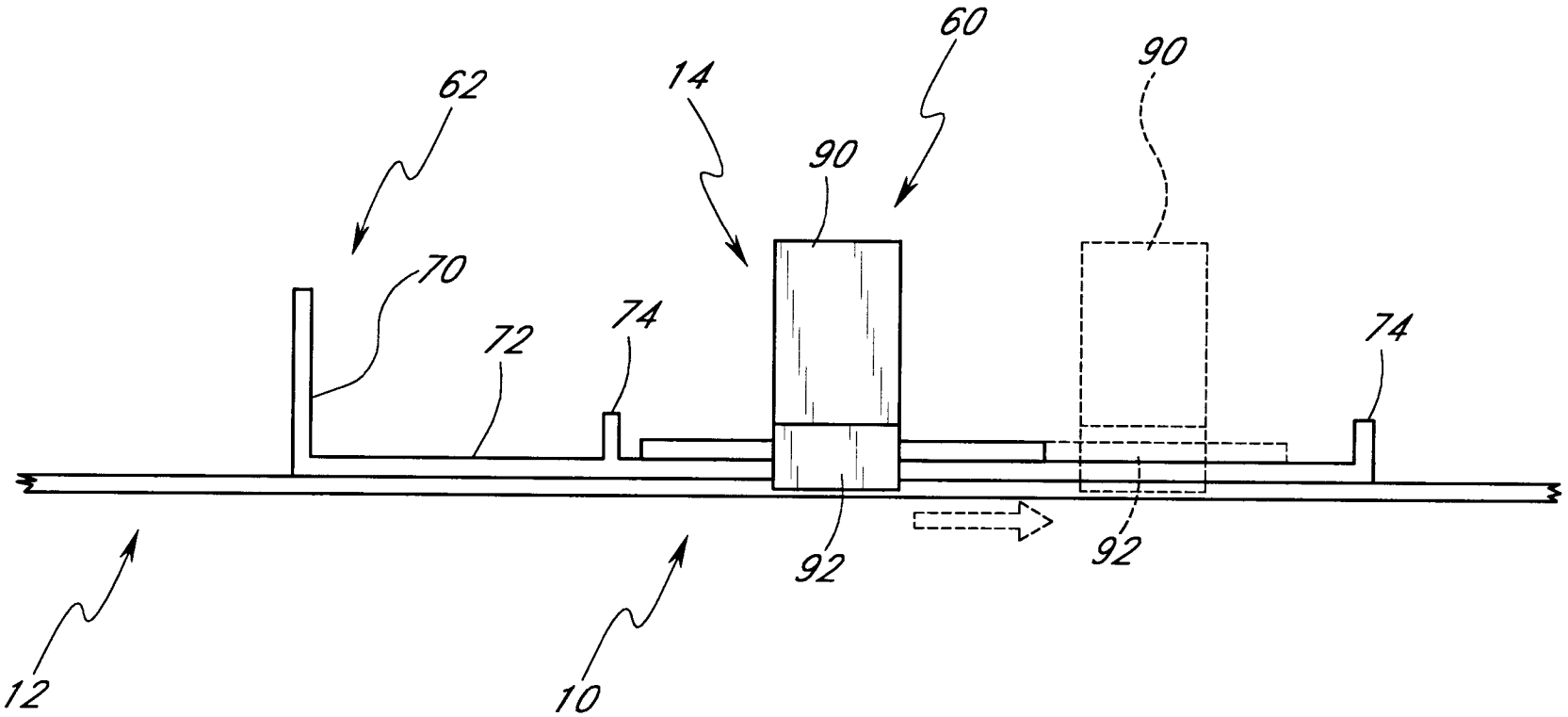
FIG. 2 is a simplified schematic front elevation view of a single laterally adjustable track and support combination that can be used with a display rack such as that illustrated in FIG. 1.

With reference to FIG. 2, a display rack 10 arranged and configured in accordance with certain features of the present invention generally features a divider 62 that comprises a partition wall 70 and a support surface 72. The divider 62 preferably is laterally moveable relative to a frame assembly 12. A track 60 and a follower assembly 14 are supported by at least a portion of the illustrated support surface 72 and are laterally slideably supported on the illustrated support surface 72 between a pair of motion limiting ribs 74. FIG. 2 illustrates movement of the track 60 and the associated follower assembly 14 with a broken line reproduction of the components and the broken line arrow showing the movement. Thus, the divider 62 provides increased load-bearing support for the track such that the track 60 can accommodate greater vertical loads. In addition, both the divider 62 and the track 60 in the illustrated arrangement are The present adjustable display rack 10 is generally comprised of a frame 12 and a follower assembly 14, which forward-feeds the shelved product. While the illustrated frame 12 may be simply placed upon a shelf or other similar structure, it is contemplated that the frame 12 may be positioned within a slideable drawer (not shown) such that the drawer may be pulled out to provide access to the entire frame 12 where the adjustable display racks 10 are oriented in close vertical relationship to one another. Such a slideable mounting assembly generally would ease product rotation for products positioned within the display rack 10 by allowing the stock person full access to the full dimension of the follower assembly 14.

With continued reference to FIG. 1, the frame 12 generally comprises a first and second end. In the preferred embodiment the first and second end are a front panel 16 and a rear panel 18. The panels 16, 18 extend generally parallel to one another at a substantially fixed distance.

Figure 5:
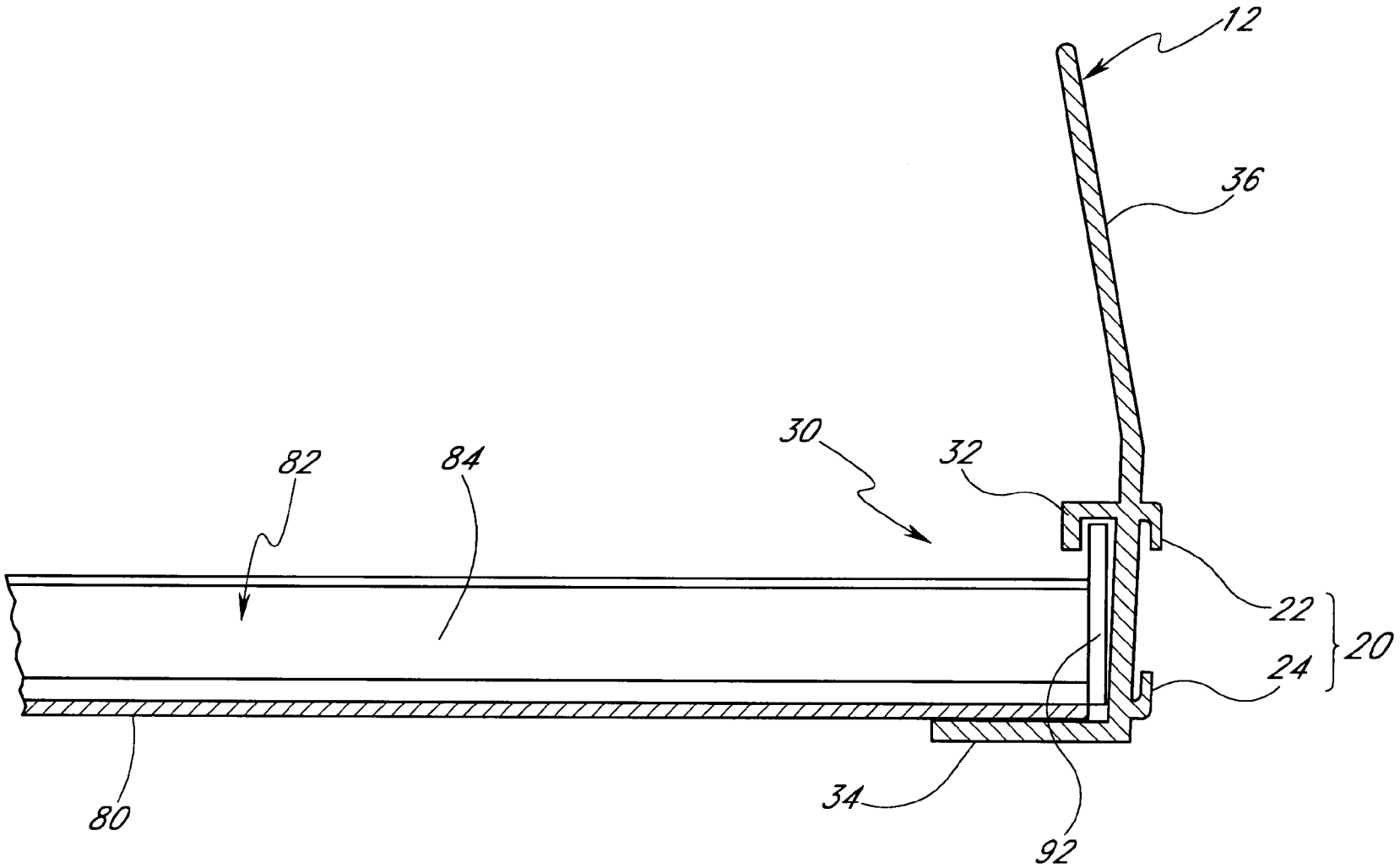
FIG. 5 is a fragmented side elevation sectional view a track and support combination mounted to a display rack in accordance with certain features, aspects and advantages of the present invention.

With reference now to FIG. 5, the illustrated front panel 16 generally comprises an inverted F configuration. Preferably, the front panel 16 comprises an integrally-formed forward-facing channel 20 generally defined by an upper lip 22 and a lower lip 24. The channel 20 is desirably sized and configured to accommodate sku identifiers or other product identification and pricing information to be positioned proximate to products which may be positioned and displayed in the adjustable display rack 10.

The front panel 20 also preferably comprises a rearward-facing race 30. The race 30 in the illustrated arrangement is generally defined by an upper flange 32 and a lower support surface 34. The race 30 preferably is sized and configured to allow relatively free movement of product tracks and dividers in manners which will be described in greater detail below. It will be recognized that other arrangements also can be used. For instance, the race 30 can be defined by a front panel that snaps downward into a slot extending along a forward edge of a shelf and an upper surface of the shelf itself, such as the constructions disclosed in co-pending U.S. patent application Ser. No. 09/518,341, which was filed on Mar. 3, 2000 and which is hereby incorporated by reference in its entirety.

With continued reference to FIG. 5, a product retaining wall 36 desirably extends upward between the forward-facing channel 20 and the race 30 and preferably angles slightly rearward from a location above the upper lip 22 and the upper flange 32. Of course, other configurations also are possible. For instance, the product retaining wall 36 may be generally vertical or may recline rearward at other locations. The product retaining wall 36 advantageously serves as a forward-most stopping surface for the adjustable display rack 10 and is desirably angled rearward to help pinch and hold product within the adjustable display rack 10 while the product is being urged forward in manners to be described in greater detail below.

The rear panel 18 can have any suitable construction. In some arrangements, the rear panel 18 is configured in a simple C shape. As such, the rear panel 18 would generally comprise an upper flange and a lower support surface, similar to the surfaces defining the race 30 of the front panel 16.

It should be noted that the lower support surface of the rear panel 18, as well as the lower support surface 34 of the front panel 16, desirably extend at greater lengths toward one another than the upper flange of the rear panel 18 and the upper flange 32 of the front panel 16. The greater extension increases the surface contact area between the lower support surfaces and any base structure, such as a shelf or a drawer, for instance, on which the adjustable display rack 10 rests.

In the illustrated configuration, the lower support surfaces each can receive a magnetized material that forms an additional layer below the lower support surfaces. This magnetic layer may extend the entire length of the front panel 16 and the rear panel 18 or can be segregated into shortened portions serving as feet for the adjustable display rack 10. In some embodiments, the additional layer may not be necessary, while in other embodiments, the additional layer may comprise rubberized components for shock absorption and the like, as well as hook and loop fasteners or other suitable securing and supporting components. It is anticipated that, in some heavy-duty arrangements, at least a portion of the front panel and/or the rear panel can be formed of a magnetizable material such that an attraction between a shelf and the front panel and/or the rear panel can be built into the construction without the need for an additional layer.

With reference again to FIGS. 1–3, the illustrated frame 12 of the rack 10 also generally comprises a first and second side. In the illustrated arrangement, the first and second sides are end pieces 40, 42. The end pieces 40, 42 may be distinct elements or may be portions of the follower assembly 14 which will be discussed in detail below.

The end pieces can be distinct elements or can be formed by the dividers 60. In either situation, the end pieces preferably are attached to the front panel 16 and the rear panel 18 to form the enclosed frame 12. The end pieces 40, 42 more preferably are attached such that one is permanently attached to the front panel 16 and the rear panel 18 while the other is semipermanently attached to the front panel 16 and the rear panel 18. Any suitable manner of connecting the members can be used. By allowing at least one of the end pieces 40, 42 to be removed, components can be easily added or removed from the races formed in the front panel 16 and the rear panel 18. Of course, it is anticipated that the dividers 62 and the tracks 60 also can be snapped in and out of the frame 12 in any suitable configuration.

The illustrated display rack 10 also comprises a plurality of tracks 60. Any number of tracks 60 can be used. The arrangement of FIG. 1 features three tracks 60. The tracks 60 generally underlie the products. As such, each track 60, at least in part, supports the products as they are moved in a forward direction.

The illustrated track 60 generally extends longitudinally between the front panel 16 and the rear panel 18. The tracks 60 are disposed laterally between the end pieces 40, 42. The illustrated track 60 is supported in manners that will be described below and carries the follower assembly 14, which will be described in greater detail.

With continued reference to FIG. 1, the tracks 60 preferably are positioned between one of the end pieces 40, 42 and a divider or between a pair of dividers 62. In some arrangements, the tracks and dividers are integrally formed (i.e., formed of a single piece—see FIG. 5).

Preferably, however, the tracks 60 and the dividers 62 are separately formed. In these arrangements, the track 60 can be positioned atop of a portion of the divider 62 in a manner that will be described such that the divider can provide increased support to the load bearing track 60. Moreover, by positioning the track 60 atop a portion of the divider 62, the display rack 10 features increased flexibility in the sizes of products which may be carried by the product tracks and the dividers. For instance, in such a separated configuration, the track 60 can be centrally positioned between the walls defined by either the end pieces 40, 42 or the dividers 62 such that decreased twisting of the products is created during forward feeding.

Figure 3:
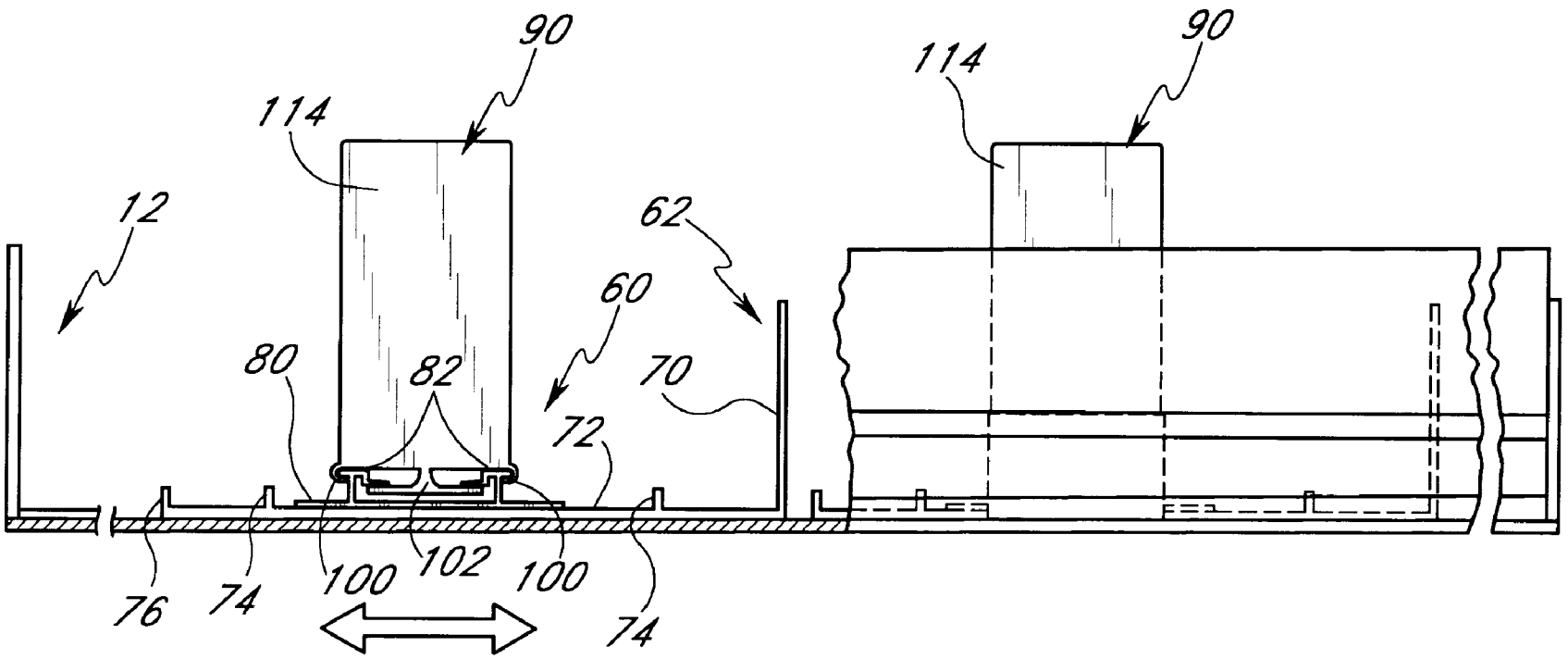
FIG. 3 is a fragmented front elevation view of a display rack showing a pair of laterally adjustable track and support combinations, similar to the track and support combination schematically illustrated in FIG. 2.
Figure 4:
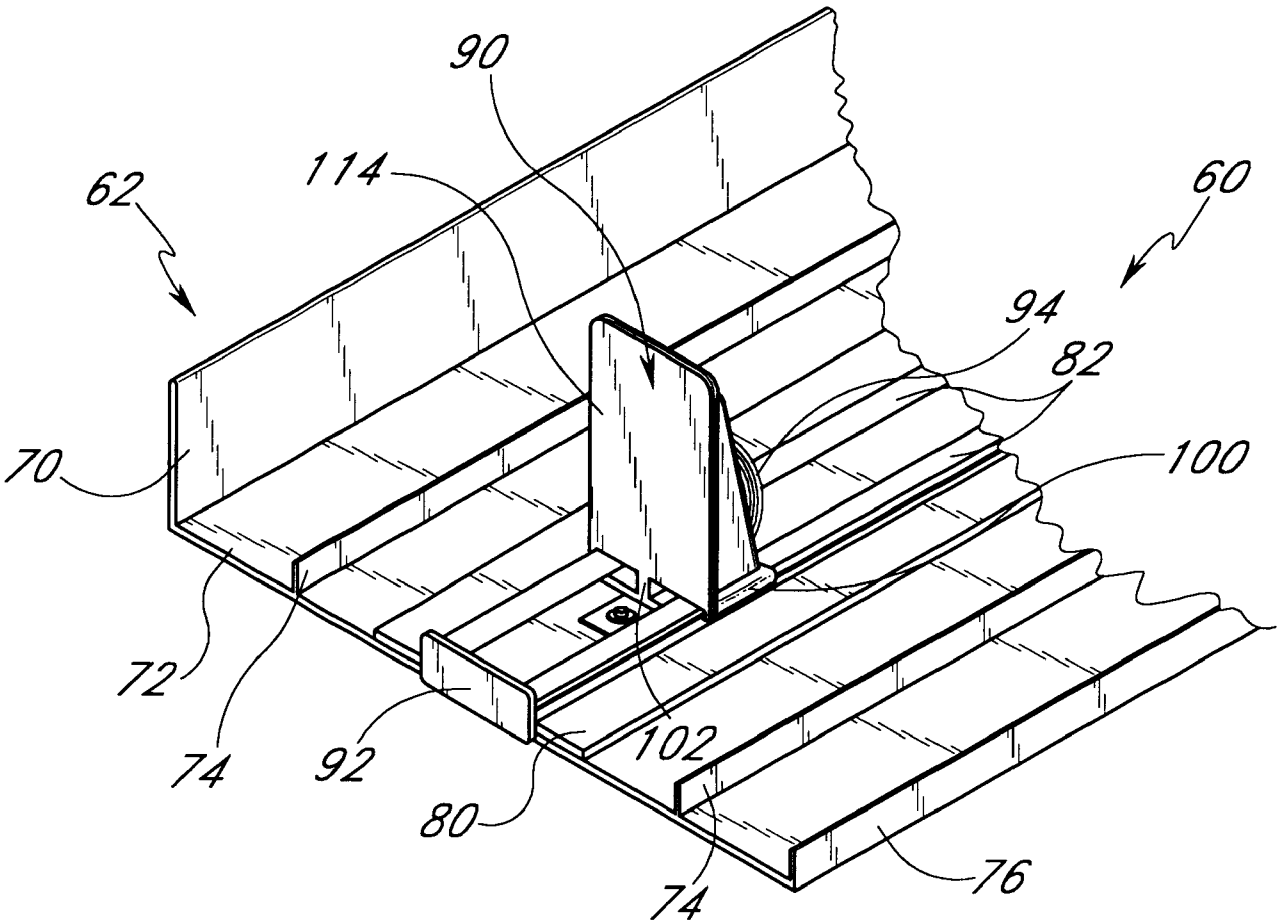
FIG. 4 is a fragmented perspective view of a laterally adjustable track and support combination.

With reference now to FIG. 3, the product track 60 and the divider 62 of a preferred arrangement will be described in more detail. An additional construction of the track 60 and the divider 62, which is substantially the opposite of the arrangement of FIG. 3, is illustrated in FIG. 4. The divider 62 generally comprises a substantially vertically-extending partition wall 70 and a generally horizontally-extending support surface 72. Preferably, the partition wall 70 and the support surface 72 are disposed at a substantially right angle to each other. In some configurations, however, the two may extend at an angle to each other. For instance, in arrangements supporting rounded articles, such as plates and the like, the partition wall 70 may extend at an obtuse angle relative to the support surface 72 to provide a surface that extends at a tangent to an outer perimeter of the supported product while the track 60 supports a portion of the product. It is also anticipated that a partition wall 70 may be interposed between a pair of support surfaces 72. For instance, a T-shape may result.

The support surface 72 preferably comprises a number of upstanding ribs 74, 76. The intermediate ribs 74 in the illustrated arrangement provide support against bending forces. In addition, the intermediate ribs 74 define a range of motion for the track 60 relative to the support surface 72. In particular, the ribs 74, together with a portion of the support surface 72, define a tray member in which the track 60 is disposed. Preferably, the separation between the ribs 74 (i.e., the width of the tray member) is substantially greater than an outer lateral dimension of the portions of the track 60 that are contained within the tray member. This configuration allows some lateral movement of the track 60 relative to the dividers 62 while also limiting the movement to a manageable range.

The outer rib 76 provides additional support against bending forces. In effect, the rib 76 primarily is a stiffening rib. Of course, in some arrangements, the rib is not formed while in other arrangements, the rib forms a second position for the track such that the track can be positioned between the outer rib 76 and the nearest intermediate rib 74. In such an arrangement, at least two positions are defined. The track 60 can be positioned in either tray and a limited lateral range of motion is defined for the track 60 in that tray. Additionally, in some configurations used with large or bulky products, multiple tracks 60 can be used such that the number of tracks supporting the products can be increased. In this regard, it is anticipated that the number of trays formed on any single divider 62 can be as few as one or more than two. Furthermore, in some arrangements, an outer rib (i.e., the rib 76) positioned farthest from the partition wall 70 can be removed and the track 60 can be allowed to translate off of the support base 72; however, the illustrated arrangement ensures that the track 60 will always be reinforced for vertical loading by the support surface 72.

The bottom of the illustrated support surface 72 of the divider 62 is substantially smooth. The bottom of the support surface can receive a friction increasing member (i.e., a roughened surface of any sort) to reduce the likelihood of lateral movement when loaded. Of course, in some configurations, movement may be desired and, in such configurations, the bottom surface may receive various treatments that will reduce the contact surface area between the bottom surface and the surface that supports the dividers 62. It also is envisioned that the divider 62 can be secured against lateral displacement by mechanical fasteners of any sort, including adhesives, epoxies, screws, rivets, brads, clips, pins and the like.

With continued reference to FIGS. 3 and 4, the track 60 generally comprises a support base 80 and a set of rails 82. The support base 80 in the illustrated arrangement preferably is a plate-like member that supports both of the rails 82. While the rails 82 generally are centrally positioned on the support base 80, the central location is not necessary and the rails 82 can be offset to one side or the other. Positioning the rails 82 in a central location, however, advantageously reduces the twisting forces that may be generated at the interface between the support base 80 and the support surface 72. In addition, the support base 80 can comprise a number of upstanding ribs, which are not shown in the illustrated arrangement, to help support the product being dispensed. In such an arrangement, the ribs preferably would extend upward to about the same height as the upper surfaces of the rails 82 and, in a more preferred arrangement, these ribs as well as the ribs 74, 76 of the divider 62 would all extend to about the same height as the upper surface of the rails 82.

The interface between the support base 80 and the support surface 72 is generally formed by two smooth surfaces in the illustrated arrangement. It is anticipated, however, that relative movement can be reduced under load if a roughened surface forms at least a portion of the interface. Generally speaking, the products typically are fairly box-like in nature and movement of the track 60 relative to the dividers 62 is not a large issue. Of course, with other types of products, such movement could be an issue and, in such arrangements, the frictional forces can be increased in any suitable manner.

The support base 80 in the illustrated arrangement is largely rectangular. It is anticipated that the support base 80 can have other structures. For instance, the support base can comprise a number of fingers that extend outward in a generally square-wave construction rather that a full rectangle. The rectangular support base 80 is presently preferred, however, because such a configuration maximizes the contact surface area while also maximizing the available range of lateral movement. It is envisioned, however, that triangular fingers, for instance, could extend laterally outward from the rails 82 and extend through gaps in the ribs 74 such that the contact surface area is not substantially reduced but the available range of lateral movement is increased.

Figure 7:
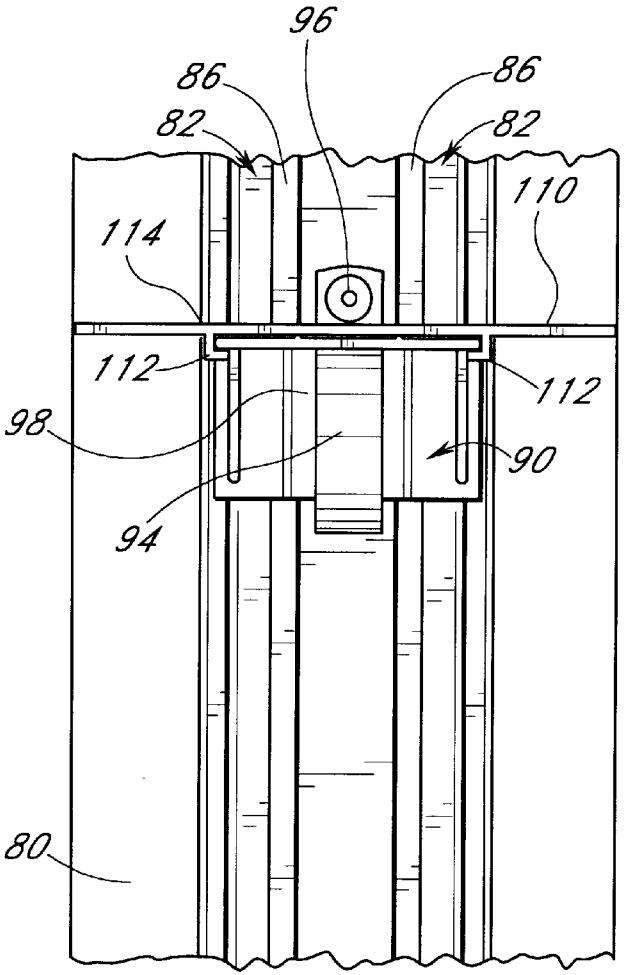
FIG. 7 is a fragmented top plan view of the track of FIG. 6.
Figure 6:
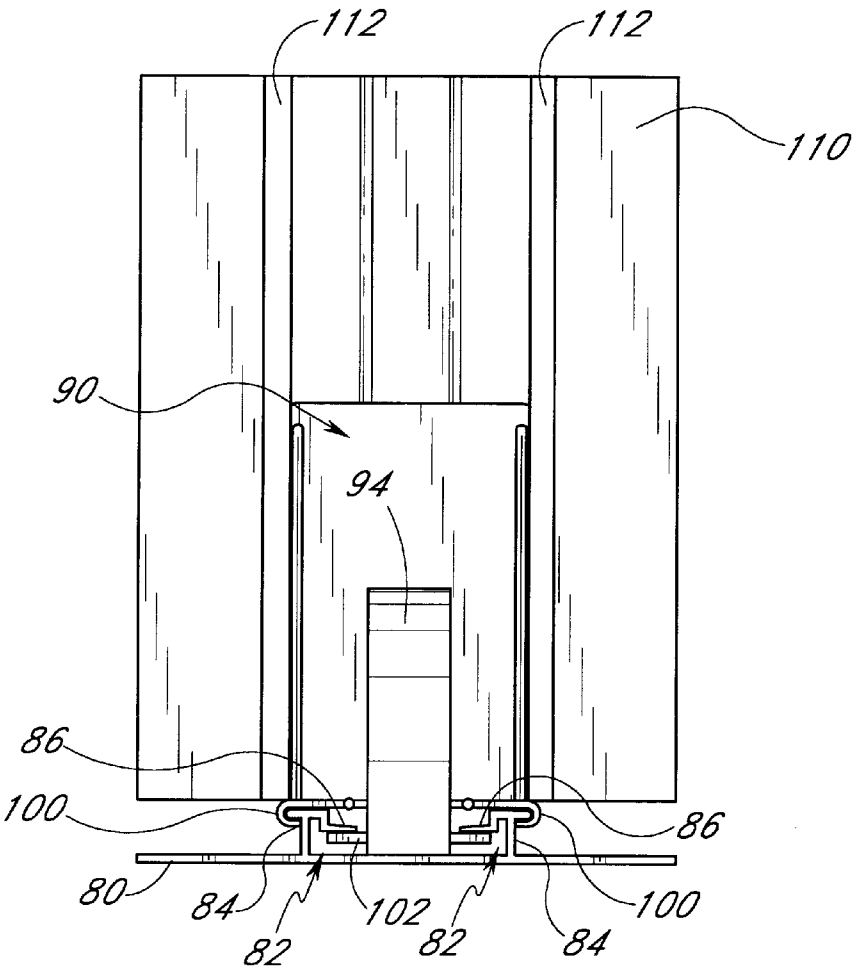
FIG. 6 is a rear elevation view of a laterally adjustable track having a pushing surface extender and a bang member.

With reference now to FIGS. 6 and 7, the illustrated track 60, rails 82 and follower assembly 14 will be described in greater detail. While the illustrated arrangements comprise but one configuration, it is the presently preferred arrangement and other arrangements are possible. As discussed above, the track 60 generally comprises the support base 80 and the pair of rails 82. The rails 82 preferably extend in a collinear fashion substantially the depth of the illustrated display rack 10.

The illustrated rails 82 have a flattened upper surface to increase the support surface area for bearing the weight of the products. The upper surface, however, is not so large that increased friction may result, which friction would tend to oppose forward movement of product. In particular, based upon the forward feeding pressure provided by the follower assembly 14, the sizing of the flattened upper surface of the rails preferably does not increase the frictional forces to a level that would not allow adequately free forward movement of the supported product.

The rails 82 further comprise a generally vertically extending rib 84. The rib 84 spaces the rails 82 from the support base 80. As illustrated clearly in FIG. 6, preferably the upper surface of the rails 82, the rib 84 and the support base 80 create a double I cross-sectional shape. It should be understood that while the presently preferred product track 60 is a straight extrusion of the plastic material, it is envisioned that the rib 84 or the support base 80, for instance, may be intermittent along the length of the rails 82.

With continued reference to FIG. 6, an inner portion of the rails 82 terminate at an inward edge with a sloping tie down surface 86. The tie down surface 86 cooperates with a pusher block 90 which reciprocates along the length of the product track 60 in manners which will be described in greater detail below.

The ends of the tracks 60 preferably are slideably connected to the front panel 16 and the rear panel 18. More preferably, the ends of the tracks 60 carry end clips 92 that are slideably disposed within the races defined within the front panel 16 and the rear panel 18. Of course, in some configurations, the end clips 92 are not used; however, the end clips 92 greatly increase the stability of the illustrated arrangement in which a track is moveable over a portion of a divider. and In general, each of the tracks 60 are generally restrained for translational movement (i.e., from side to side) along the front panel 20 and the rear panel 22. Additionally, a secure connection of the product tracks 60 with the frame 12 is created when both the front and the rear of the track 60 are secured in races. The end clip 92 may be attached to the track 60 in any suitable manner, including friction fitting, threaded fasteners, fasteners, detents, and any other suitable method.

With reference now to FIGS. 6 and 7, the pusher block 90 comprises a spring or other biasing member 94 that biases the pusher block 90 toward a forward end of the track 6. The pusher block 90 also features a sliding connection with the track 60. The biasing member 94 preferably is a roll spring. The roll spring has characteristics that make it desirable over various other springs, such as compression springs. For instance, the roll spring naturally recoils after being extended and released. The recoiling involves rolling of the coil into its tightly wound initial state. Of course, coil springs may be used, however, they are not presently preferred. Moreover, elastic straps, ropes, and a variety of other springs and biasing members may be used. The roll spring may be permanently, semi-permanently or removably attached to the track 60. It is presently preferred, however, that the roll spring be permanently or semi-permanently attached to the product track 60 using a rivet 96. It is envisioned, however, that threaded fasteners, fasteners, pins, connectors and couplings of any suitable type may also be used. Of course, the end clip 92 also can be used to attached the biasing member 94 to the track 60.

The portion of the biasing member 94 that is in contact with the pusher block 90 rests on a spring carrying surface 98 of the pusher block 90. Due to the unique configuration of the roll spring, no permanent attachment or semi-permanent attachment is necessary to maintain the spring's position on the spring carrier surface 98 when the roll spring forms the biasing member 94. Indeed, the forward tension of the roll spring, which would be opposed by any product positioned forward of the pusher block 90, would help to maintain the position of the roll spring on the spring carrier surface 98.

The illustrated pusher block 90 slideably connected to the track 60. With continued reference to FIGS. 3 and 6, the pusher block 90 generally comprises a pair of inwardly extending flanges 100 and an inverted T-shaped hold down member 102. The inwardly extending flanges 100 capture outer edges of the rails 82 while the T-shaped hold down member 102 captures the inner edges of the tie down surfaces 86. By gripping both the inside and the outside of each rail 82, the pusher block 90 is better secured to the track 60 and is less likely to inadvertently separate under twisting forces.

Various accessories may be added to the adjustable display rack 10 configured and arranged in accordance with the present invention. For instance, with reference to FIGS. 6 and 7, an increased size pushing paddle 110 is illustrated therein. The pushing paddle 110 increases the contact surface area between the product being moved forward and the pusher block 90. Specifically, the paddle 110 is arranged with a pair of inwardly extending flanges 112 that are sized and configured to create a channel that slip fits over a product pushing surface 114 of the pusher block 90.

Generally, the components of the display rack 10 may be comprised of any suitable material. Materials presently preferred are materials from the styrene family or self-lubricating FDA approved plastics, such as, but not limited to, acrylonitrile-butadiene-styrene (ABS). In some embodiments, however, the components may be manufactured from stainless steel, UHMW, or other FDA approved materials. The materials preferably are chosen to allow for easy cleaning and to reduce adsorption of liquids. In applications not involving food products, the materials may be chosen from any material considered desirable to those of the user. Where materials are not judiciously chosen to result in a self-lubricating nature to the product, materials such as brass or bronze or any other bearing type surface material may be utilized with steels and the like. Additionally, a silicon spray may be used to coat the surfaces to increase the lubrication between the moving components.

In some arrangements, the front panel 16 may be opaque, transparent or translucent. In the present and preferred embodiment, the front panel 16 is comprised of a clear plastic material to allow the prospective purchaser a clear line of vision to the product being carried by the adjustable display rack 10.

When assembling the above-described display rack 10, the track 60 preferably comprises at least one end clip 92. The track 60 is positioned atop of a divider 62 between a chosen set of ribs 74, 76. The track 60 and the divider 62 are then assembled to the frame 12. For instance, the end clip 92 is inserted into the respective race 30. In arrangements featuring a front end clip and a rear end clip, the two end clips are inserted into the associated races. The track 60, thus, is secured to the front panel 16 and the rear panel 18 and the base support 80 secures the divider 62 to the frame 12. More particularly, the track 60 is secured to the frame 12 by the captured end piece 92 and the track 60, which lies on top of a portion of the divider 62, acts to hold the divider 62 within the frame 12. Of course, both the track 60 and the divider 62 remain generally freely laterally translatable relative to the frame 12, as described above. In some arrangements, the ribs 74, 76 also are received within the channel defined by the race 34 and the ribs 74, 76 help to secure the divider 62 in position within the frame.

The ability to slidably move the tracks and dividers, the ability to add and remove tracks and dividers, and the ease with which this is done makes the display rack arranged and configured in accordance with certain features, aspects and advantages of the present invention infinitely variable with respect to width of a product. In addition, the ability to reinforce tracks with the base portion of the dividers makes the display rack of the present invention more capable of being used with a large variety of products.

Although the present invention has been described in terms of a certain preferred embodiments, other embodiments apparent to those of ordinary skill in the art also are within the scope of this invention. Thus, various changes and modifications may be made without departing from the spirit and scope of the invention. For instance, various components may be resized, reconfigured or repositioned as desired. Moreover, not all of the features, aspects and advantages are necessarily required to practice other features, aspects and advantages of the present invention. Accordingly, the scope of the present invention is intended to be defined only by a fair reading of the claims that follow.

What is claimed is:

1. A display rack comprising a frame, a base unit and a track, said base unit comprising a generally vertical dividing wall portion and a generally horizontal support surface portion, said track being disposed on said generally horizontal support surface portion, said track carrying a pusher block, said pusher block being capable of translating along said track in a generally longitudinal direction there to and being biased to a forward direction, and said track being capable of translating along said support surface portion of said base unit in a generally lateral direction without removal from said base unit and said base unit being capable of translating along said frame in a generally lateral direction without removal from said frame.

2. The display rack of claim 1, wherein said base unit comprises a first pair of generally parallel vertical ribs extending upward from said support surface portion and extending generally parallel to said track, said track being disposed between said ribs and said ribs defining a range of lateral motion of said track, whereby the lateral motion is generally normal to said generally longitudinal direction that said pusher block is capable of translating along.

3. The display rack of claim 1, wherein said support surface portion comprises a top surface and a bottom surface and said track comprises a base plate having a contact surface, said contact surface and said top surface both being substantially smooth such that a low friction interface is achieved between said base plate and said support surface portion.

4. The display rack of claim 3 wherein said base unit further comprises a first pair of longitudinal ribs extending upward from said support surface portion, said first pair of ribs being separated by a first lateral dimension, said base plate having a second lateral dimension and said first lateral dimension being greater than said second lateral dimension.

5. The display rack of claim 4, wherein said ribs are continuous.

6. The display rack of claim 4, further comprising an additional rib disposed along a lateral edge of said support surface portion located opposite said dividing wall portion.

7. The display rack of claim 1 further comprising an end clip that is connected to said track and said end clip being slidably received within a portion of said frame.

8. The display rack of claim 7, wherein said base unit is secured in vertical position at least in part by said track and said track is secured in vertical position at least in part by said end clip and said frame.

9. The display rack of claim 1 wherein said base unit supports only a single track.

10. A display rack comprising a front panel, a rear panel spaced from said front panel, at least one divider generally extending between said front panel and said rear panel, said divider comprising a support surface and a partition, said divider being laterally slidable relative to said front panel, a track being laterally slidably positioned on said support surface, said track generally extending between said front panel and said rear panel, said track supporting a forward biased pusher block, said track being connected to at least one of said front panel and said rear panel such that said track is secured from substantial vertical movement and said track at least partially securing said divider from substantial vertical movement.

11. The display rack of claim 10, wherein said support surface is generally horizontally extending.

12. The display rack of claim 11, wherein said partition is generally vertically extending.

13. The display rack of claim 10, wherein said track is connected to said front panel and said rear panel.

14. The display rack of claim 10, wherein at least one of said front panel and said rear panel comprises a laterally extending groove, said track being secured in said groove for lateral movement.

15. The display rack of claim 14, wherein said groove is formed in said front panel and said rear panel also comprises a groove, said track being secured in both of said grooves for lateral movement.

16. The display rack of claim 10, wherein said support surface comprises a first generally vertical rib and a second generally vertical rib, said track being positioned between said ribs.

17. The display rack of claim 10, wherein said track has a first generally horizontal product supporting surface, said first generally horizontal product supporting surface of said track having a first height relative to said support surface of said divider, said first and second ribs extending upward from said support surface of said divider.

* * * * *